US009127392B2

(12) United States Patent
Amos et al.

(10) Patent No.: US 9,127,392 B2
(45) Date of Patent: Sep. 8, 2015

(54) METHOD AND APPARATUS TO DETECT AN OVER-SUDS CONDITION

(75) Inventors: Sylvan J. Amos, Kalamazoo, MI (US); Yingqin Yuan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1118 days.

(21) Appl. No.: 12/905,127

(22) Filed: Oct. 15, 2010

(65) Prior Publication Data

US 2012/0090098 A1 Apr. 19, 2012

(51) Int. Cl.

| | |
|---|---|
| ***D06F 3/00*** | (2006.01) |
| ***D06L 1/20*** | (2006.01) |
| ***D06F 39/06*** | (2006.01) |

(52) U.S. Cl.
CPC ..... *D06F 39/06* (2013.01)

(58) Field of Classification Search
CPC ..... D60F 39/06
USPC ..... 8/137, 158, 159; 68/12.05
See application file for complete search history.

(56) References Cited

U.S. PATENT DOCUMENTS

| | | | | |
|---|---|---|---|---|
| 4,986,093 | A * | 1/1991 | Pastryk et al. | 68/13 R |
| 5,127,243 | A * | 7/1992 | Babuin et al. | 68/12.05 |
| 5,890,247 | A | 4/1999 | Erickson et al. | |
| 7,340,792 | B2 * | 3/2008 | Czyzewski et al. | 8/158 |
| 2005/0197264 | A1 * | 9/2005 | Czyzewski et al. | 510/137 |
| 2008/0134447 | A1 * | 6/2008 | Schulze | 8/159 |
| 2010/0192310 | A1 * | 8/2010 | Moschutz | 8/137 |

FOREIGN PATENT DOCUMENTS

| | | | |
|---|---|---|---|
| DE | 3703917 | A1 | 8/1988 |
| DE | 19549044 | C1 | 9/1997 |
| DE | 10234472 | A1 | 2/2004 |
| DE | 102007033492 | A1 * | 1/2009 |
| DE | 102007042968 | A1 | 3/2009 |
| DE | 102009045433 | A1 | 4/2011 |
| EP | 0278239 | B1 | 8/1988 |
| EP | 0724036 | A1 | 7/1996 |
| EP | 1719832 | A1 | 11/2006 |

OTHER PUBLICATIONS

Machine Translation of DE 102007033492 to Moschutz, Jan. 2009.*
German Search Report for DE102011052619, Nov. 29, 2011.

* cited by examiner

*Primary Examiner* — Michael Barr
*Assistant Examiner* — Benjamin L Osterhout

(57) ABSTRACT

Example methods for determining an over-sudsing condition during a wash cycle of operation in a laundry treating appliance containing a foamable liquid are disclosed. An example method includes rotating within a tub a drum defining a treating chamber while the tub contains a foamable liquid, determining, over time, a fluctuation in a signal from a pressure sensor fluidly coupled to the tub while the drum is rotating, the signal representing an amount of water in the tub, determining an over-sudsing condition when the fluctuation satisfies a predetermined threshold, and altering a cycle of operation in response to the determination of an over-sudsing condition.

20 Claims, 10 Drawing Sheets

METHOD AND APPARATUS TO DETECT AN OVER-SUDS CONDITION

BACKGROUND OF THE INVENTION

Laundry treating appliances wash laundry using a treating chemistry, such as a wash liquor. The wash liquor may contain solvents, such as water and surfactants, as well as other agents. The surfactants may reduce the surface tension of water to enhance cleaning action. The reduced surface tension may also result in enhanced foaming of the wash liquor. Excessive foaming or an over-sudsing condition may lead to reduced effect of mechanical energy applied to the laundry for cleaning, such as, for example, the suds may insulate the impact of the laundry on the side of the drum. Detection of an over-sudsing condition may allow for responding to the over-sudsing condition to enable a more effective wash cycle of operation.

SUMMARY OF THE INVENTION

One embodiment of the invention is related to a method for determining an over-sudsing condition in a laundry treating appliance comprising multiple components for implementing a washing cycle of operation including a tub for holding liquid, a drum defining a treating chamber rotatably mounted within the tub, a pressure sensor fluidly coupled to the tub and outputting a signal indicative of the amount of water in the tub, and a controller coupled to and controlling the components, including receiving the signal and implementing the cycle of operation. The method comprises rotating the drum while the tub contains a foamable liquid, determining, over time, a fluctuation in the signal from the pressure sensor while the drum is rotating, determining an over-sudsing condition when the fluctuation satisfies a predetermined threshold, and altering the cycle of operation in response to the determination of an over-sudsing condition.

DESCRIPTION OF AN EMBODIMENT OF THE INVENTION

The present invention relates generally to a laundry treating appliance and detecting an over-sudsing condition (OSC) within the laundry treating appliance. More specifically, the invention is related to detecting an OSC by processing the signal of a pressure sensor measuring the amount of and the pressure of liquid within the laundry treating appliance.

Figure 1:
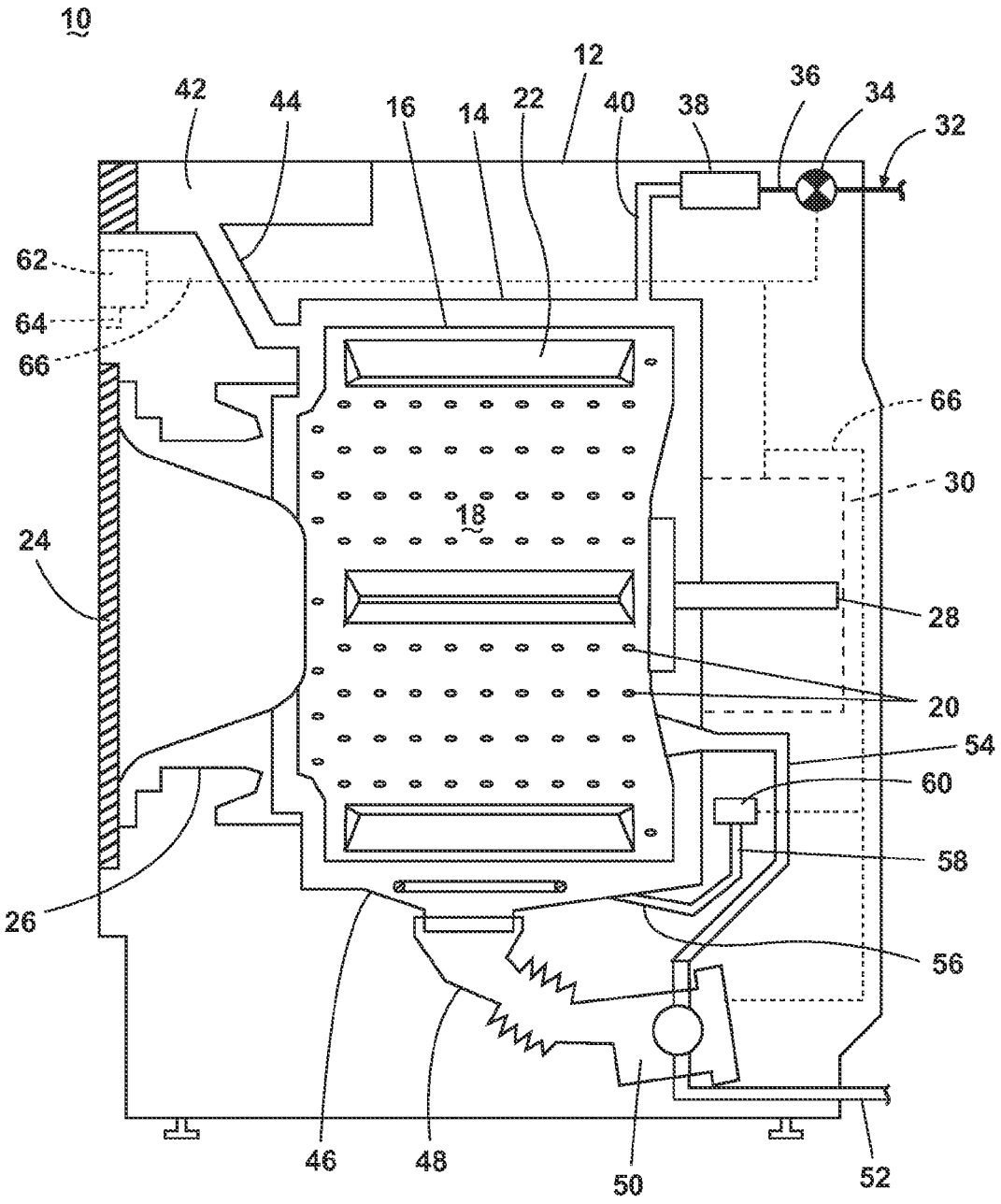
FIG. 1 is a sectional view of a laundry treating appliance according to one embodiment of the invention.

FIG. 1 is a sectional view of a laundry treating appliance 10 having a cabinet 12 and a tub 14 for holding liquid contained therein. A drum 16 defining a treatment chamber 18 may be rotatably mounted within the tub 14. The drum 16 may have multiple holes 20 to allow flow of liquid from the tub 14 in to the drum 16. The drum may also contain baffles 22 for the purpose of lifting and dropping the clothes in the drum to transfer mechanical energy from the drum 16 to the clothes contained therein when the drum 16 rotates during a wash cycle of operation. The treatment chamber 18 may be accessed by a door 24 hingably disposed on the cabinet 12. A bellows 26 may seal the door with the tub 14 and drum 16 to prevent leaking of liquid contained within the tub 14.

The tub 14 may further contain a sump 46 connected to a recirculation pump 50 via a sump conduit 48. The recirculation pump 50 may selectively pump liquid contained within the sump back in to the tub 14 via a recirculation conduit 54 or to a household drain (not shown) via a drain conduit 52. There may also be a water inlet 40 to the tub 14 for introducing fresh household tap water to the laundry treating appliance 10. There may be water source 32 external to the laundry treating appliance coupled to an inlet valve 34 to actuate the flow of water from the water source 32. A filter conduit 36 downstream of the inlet valve 34 leads to a water filter 38 for removing particulates from water coming from the water source 32. An inlet conduit 40 in fluid communication with the water filter 38 and the tub 14 may provide water to the tub 14 when the inlet valve 34 allows the flow of water from the water source 32.

A laundry treatment agent dispenser 42 accessible from outside the cabinet 12 for holding a laundry treatment agent (not shown) and dispensing the agent in to the tub 14 via laundry treatment agent conduit 44 and may be provided.

A drive system having a shaft 28 attached to the drum 16 and coupled to a motor assembly 30 is provided for rotating the drum 16 when the laundry treating appliance 10 runs a wash cycle of operation.

A pressure sensor 60 for measuring the pressure on the water in the sump 46 may be coupled to the tub, such as at the sump 46, by way of a tube 58, in which may be provided an airlock 56. All of the electronic components of the laundry treatment appliance 10, including the inlet valve 34, the motor 30, the recirculation pump 50, and the pressure sensor 60 may be controlled by a controller 62 with electronic memory 64 that is communicatively coupled to the electronic components via a communications pathway 66.

The pressure sensor 60 may be an analog pressure sensor or a digital pressure sensor. The pressure sensor 60 may output a signal that is indicative of the amount or level of liquid in the tub. The signal may be a voltage or current signal that is related to the amount of water in the tub 14 and the pressure imparted on the water in the tub 14 during a wash cycle of operation. The voltage or current signal of the pressure sensor 60 may further be directly and linearly related to the head pressure of the water in the tub 14 and pressure imparted on the water by the tub 14 and laundry during a wash cycle of operation.

The controller 62 may be a microprocessor, microcontroller, field programmable gate array (FPGA), application specific integrated circuit (ASIC), or any other known electronic controller. The controller 62 may receive the signal from the pressure sensor 60. The controller 62 may further process and store the signal from the pressure sensor 60 in the electronic memory 64. The controller 62 may, for example determine, over time, a fluctuation in the signal from the pressure sensor 60 while the drum 16 is rotating, and compare the fluctuation in the signal to a predetermined threshold to determine an over-sudsing condition in the tub 14. The controller 62 may further alter the cycle of operation in the laundry treating appliance 10 in response to the determination of an over-sudsing condition. The controller 62 may also serve the purpose of controlling the wash cycle of operation of the laundry treating appliance 10. The memory may be a dynamic random access memory (DRAM), static random access memory (SRAM), or any other known type of electronic memory and may be used by the controller 62 to store pressure sensor 60 signals and parameters for various wash cycles of operation.

While the laundry treating appliance 10 of FIG. 1 is a horizontal axis clothes washer, the invention may be used in a variety of different laundry treating appliances. Other non-limiting examples of the laundry treating appliance 10 include a vertical axis laundry washing machine; a combination washing machine and dryer; and a tumbling refreshing/revitalizing machine.

Figure 2:
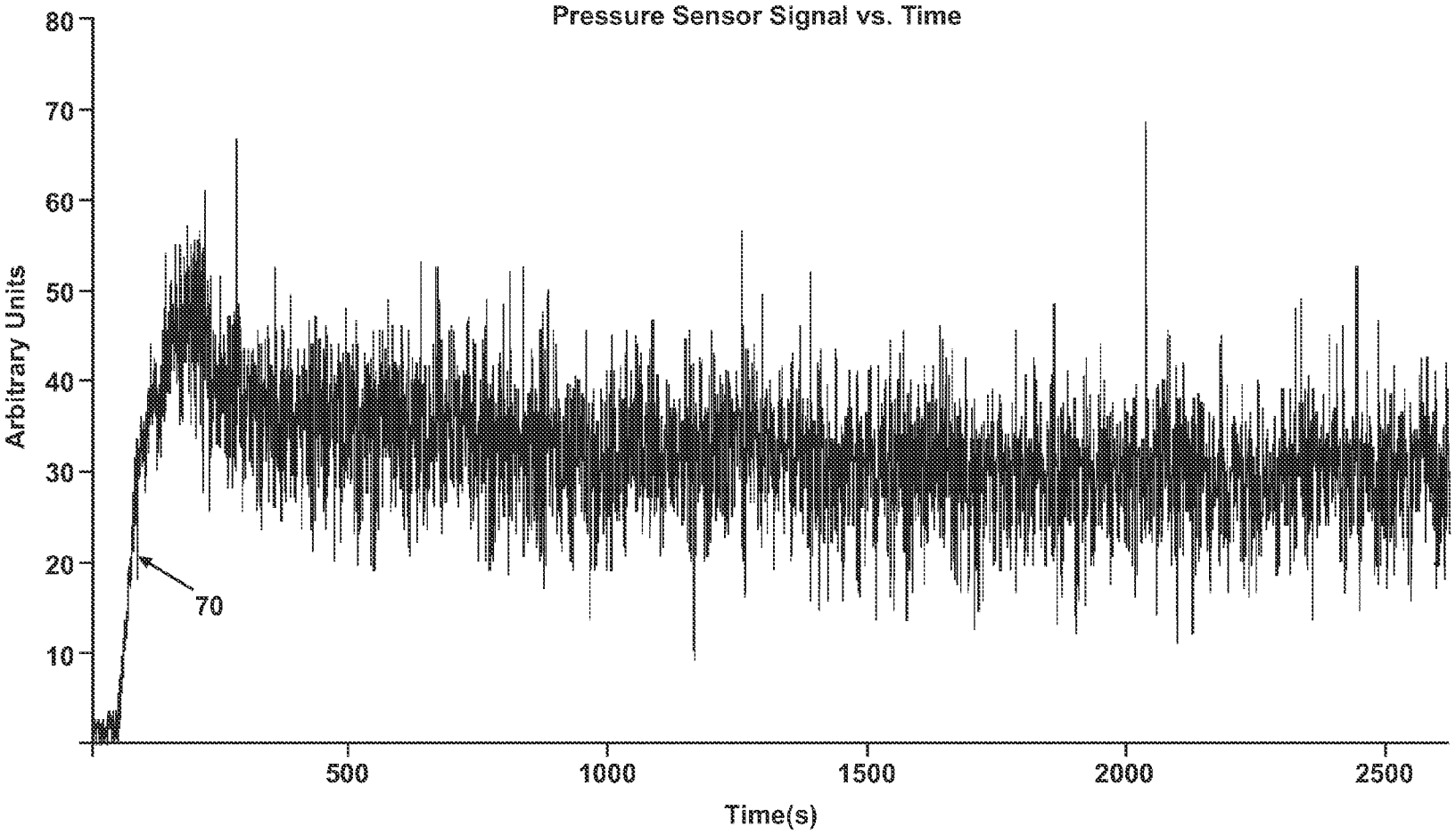
FIG. 2 is a graph of an analog pressure sensor signal as a function of time for a non-over-sudsing condition.
Figure 3:
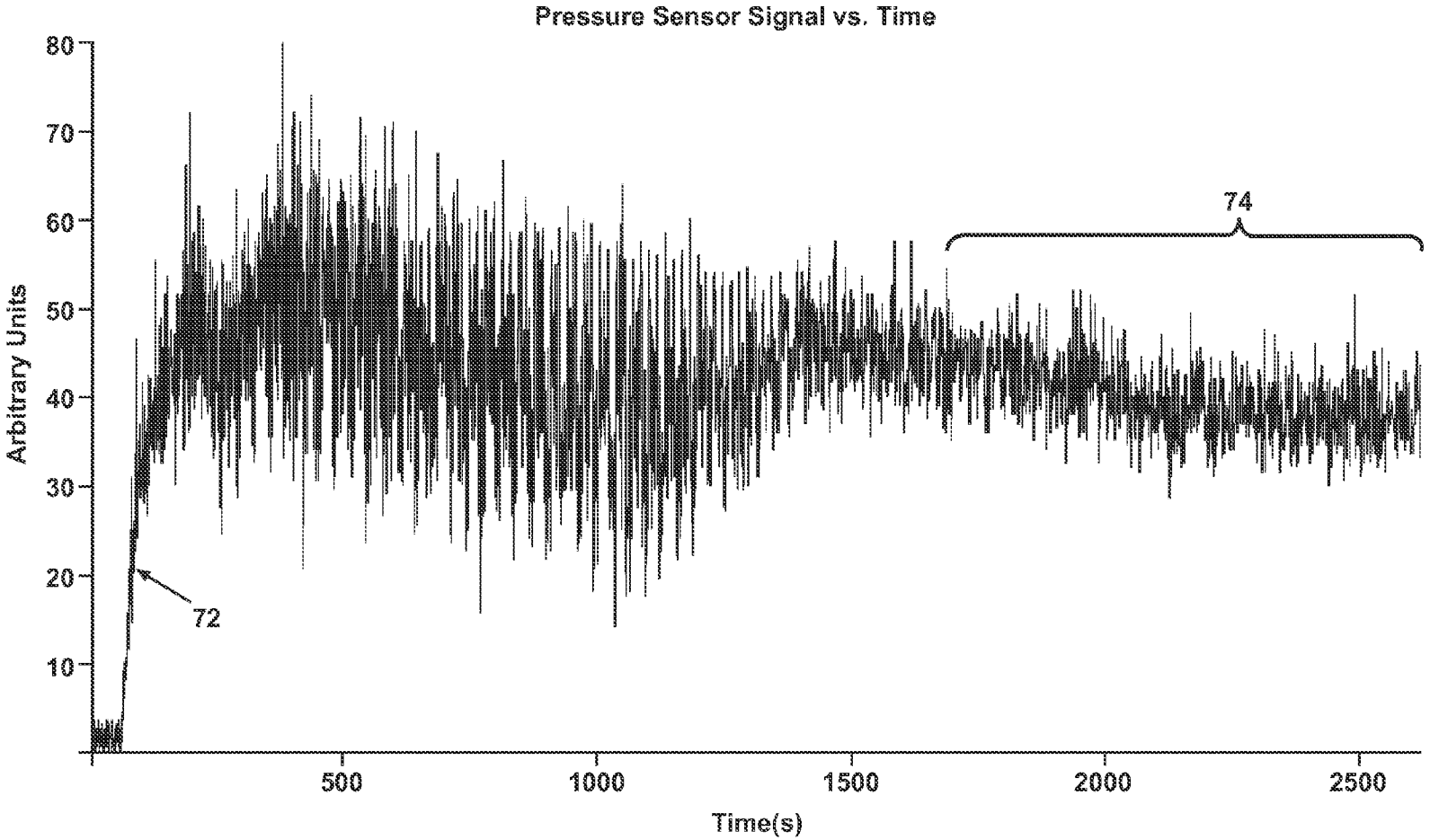
FIG. 3 is a graph of an analog pressure sensor signal as a function of time in an over-sudsing condition.

FIG. 2 is a graph of a time series of analog pressure sensor signal 70 as a function of time for a non-over-sudsing condition (NOSC), and may be compared with FIG. 3, which is a graph of a time series of analog pressure sensor signal 72 as a function of time for an over-sudsing condition (OSC). The pressure sensor sampling rate for both FIGS. 2 and 3 was selected as 1 KHz, or 1000 samples per second. The magnitude of the signal has been plotted against an arbitrary unit.

As is readily seen in both FIGS. 2 and 3, the pressure sensor signals 70 and 72 may exhibit a high degree of fluctuation compared to a moving average of the signal, for example on the order of 60% of the signal. The fluctuation in the NOSC is relatively consistent through the wash cycle represented by FIG. 2. However, the fluctuation in the OSC, which is identified in FIG. 3 by the bracket 74, has noticeably less fluctuation than the NOSC. The discovery of this phenomenon provides the basis for method and apparatus of the invention.

As currently understood, it is believed that the phenomena is because the pressure sensor signal may be indicative of both the amount of water in the tub, as well as the pressure imparted on the water in the tub from the laundry landing on the water as the drum 16 rotates. When there is excessive foaming, or an OSC within the tub 14, the quantum of force imparted to the surface of the water in the tub 14 may be reduced as a result of the suds damping the velocity and force of the laundry landing on the water in the tub 14. The reduction in force imparted to the surface of the water as the laundry lands thereon may be detected as a reduced fluctuation in the pressure sensor signal. This phenomenon is used in the method disclosed herein to detect an OSC. In brief, the method segments the continuously collected pressure sensor signals into multiple segments and then calculates a mean and range of the pressure sensor signals within each of these segments. The determined series of means and ranges of the segments are used to determine if an OSC exists. If an OSC exists, then a suds handling routine may be run, otherwise the pressure sensor signal continues to be monitored, segmented and analyzed until an OSC is detected or the wash phase ends.

Figure 4:
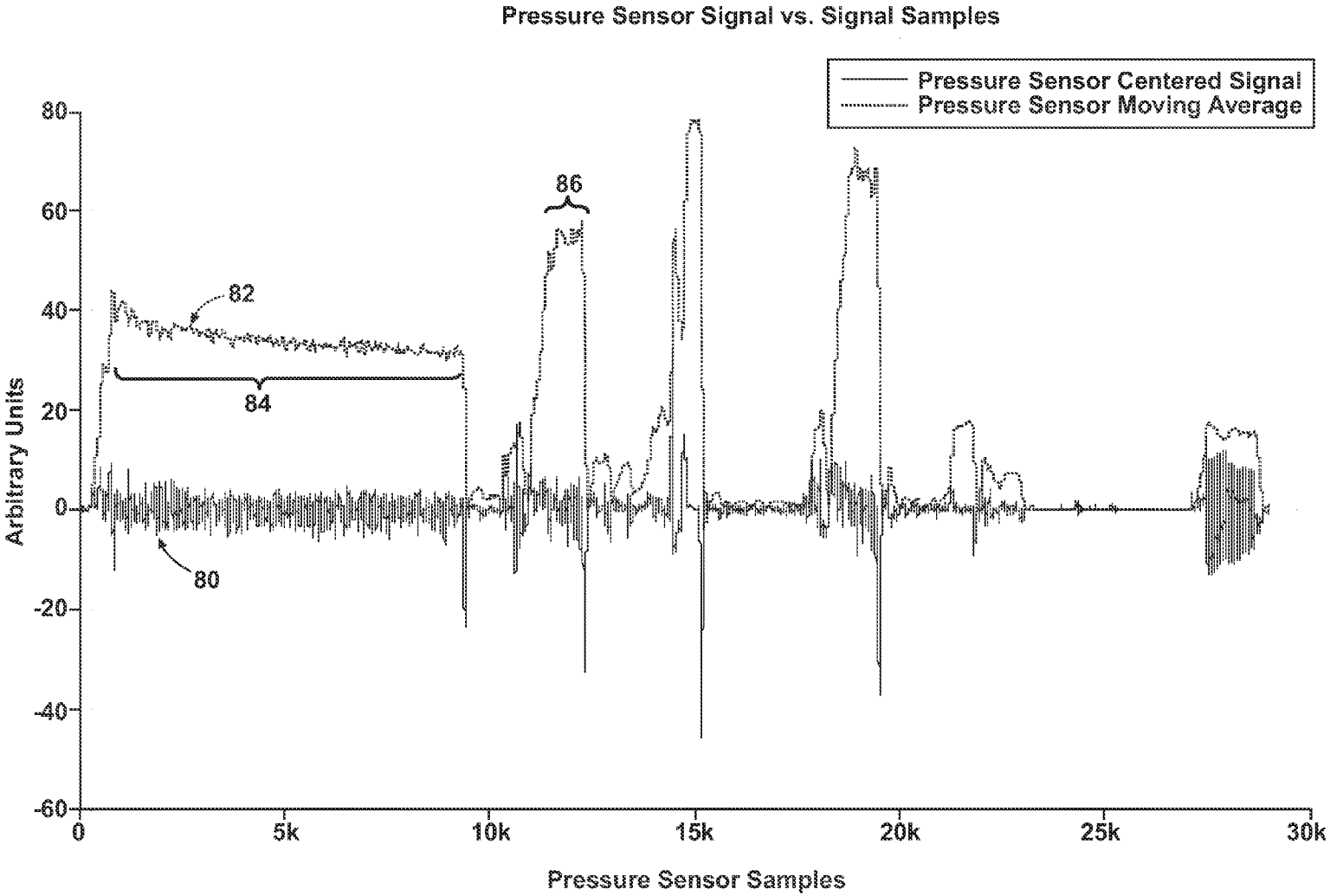
FIG. 4 is a graph of an analog pressure sensor signal decomposed into a mean centered and a moving average as a function of time for a non-over-sudsing condition (NOSC).
Figure 5:
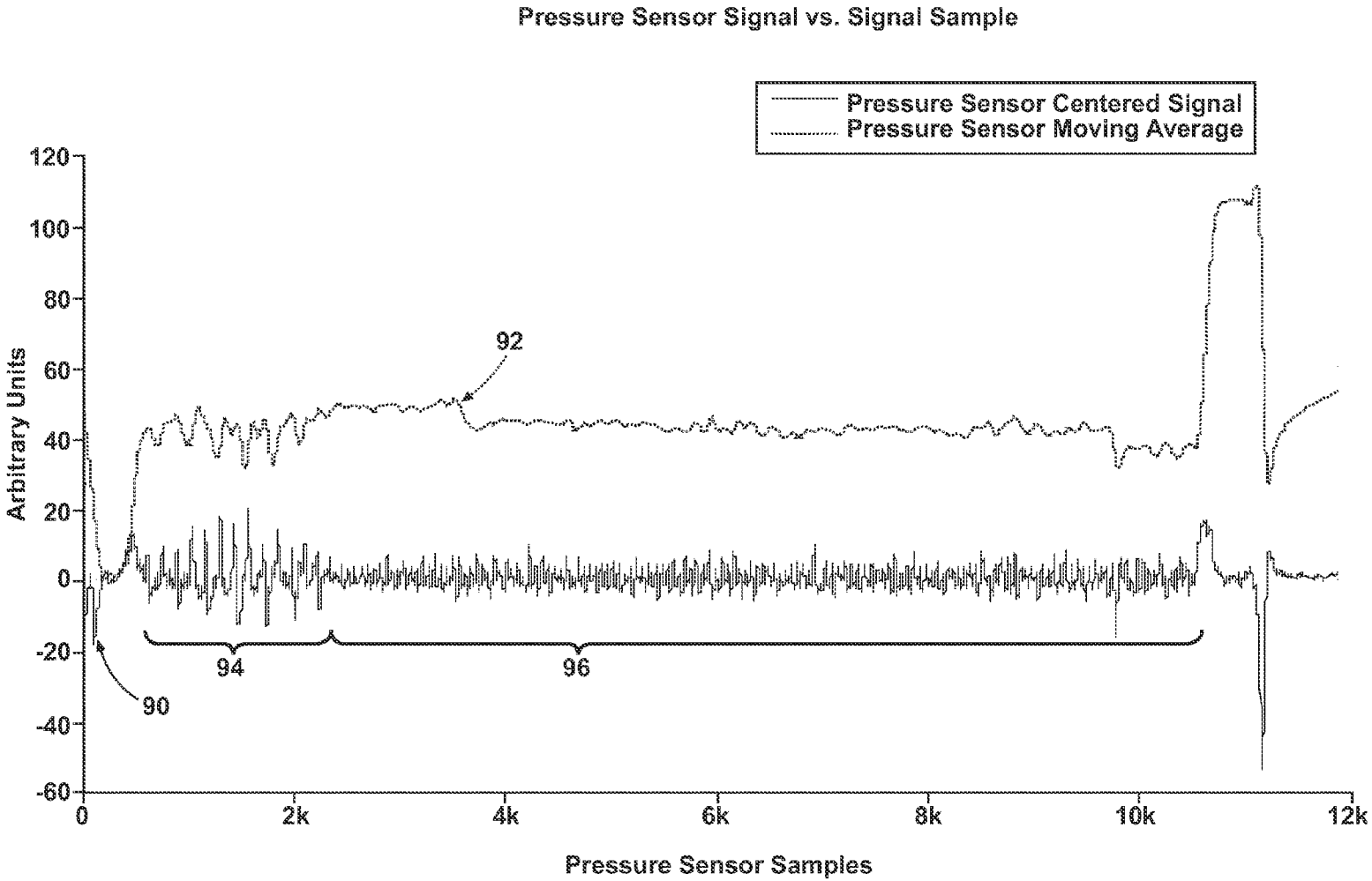
FIG. 5 is a graph of an analog pressure sensor signal decomposed into a mean centered and a moving average as a function of time for an over-sudsing condition (OSC).

The pressure sensor signal behavior may be easier to see in conjunction with FIGS. 4 and 5, which show a NOSC pressure sensor signal (FIG. 4) and an OSC pressure sensor signal (FIG. 5) decomposed into two distinct signals: a pressure sensor signal moving average 82, 92 and a pressure sensor zero centered signal 80, 90. The moving average 82 and 92 may be determined using a variety of different methods. As illustrated, the moving average 82 and 92 is determined by continuously averaging a predetermined number of the most recent signal samples from the pressure sensor 60. The zero centered signal 80 and 90 may be determined using a variety of different methods. As illustrated, the zero centered signal 80 and 90 is determined by subtracting the moving average 82 and 92 from the current pressure sensor signal.

As seen in FIG. 4, for the NOSC there may be different phases 84 and 86 in the wash cycle where the moving average 82 changes depending on the amount of water in the tub 14 or the rotation speed of the drum 16. It can be seen for this NOSC that the zero-centered signal 80 has a fluctuation that is relatively consistent throughout any given wash phase 84 and 86. However, as seen in FIG. 5, for an OSC as identified by the portion of the signal with bracket 96, the fluctuation of the moving average signal 92 and the centered signal 90 are both quite less than for the NOSC.

Figure 6:
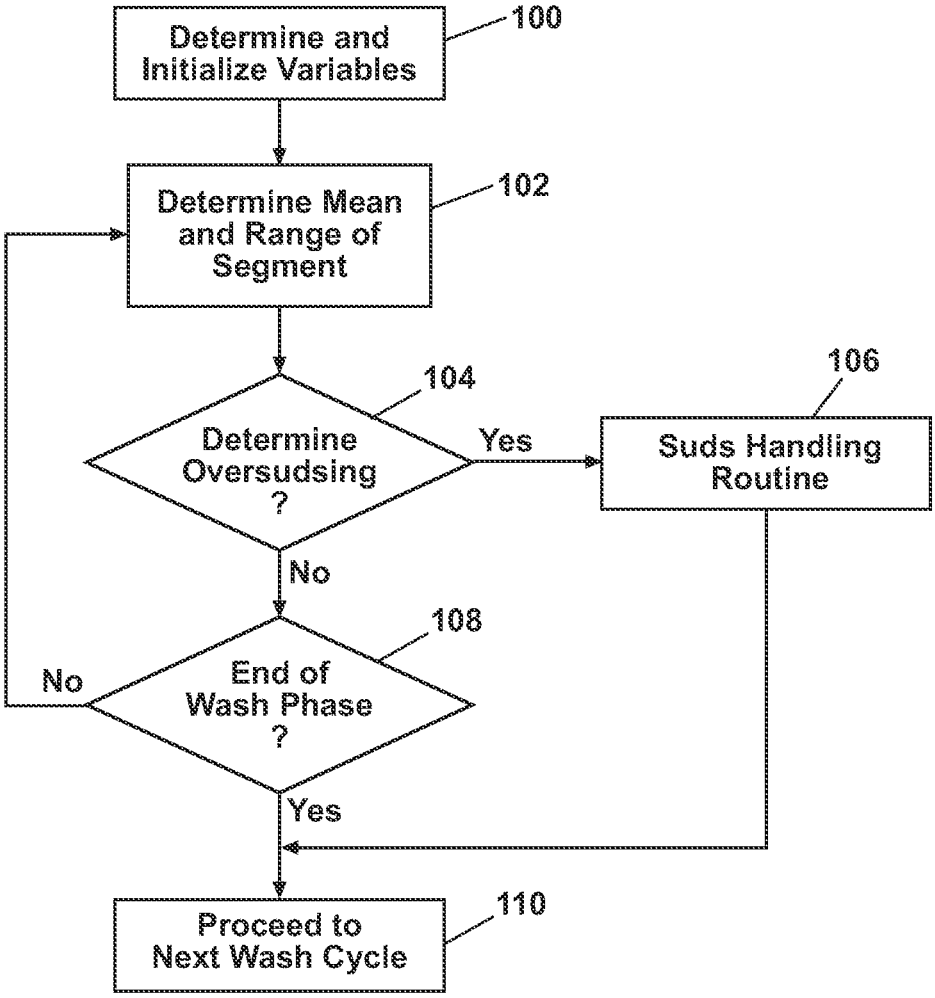
FIG. 6 is a flow chart depicting an embodiment of a method to detect an over-sudsing condition in the laundry treating appliance of FIG. 1.
Figure 7:
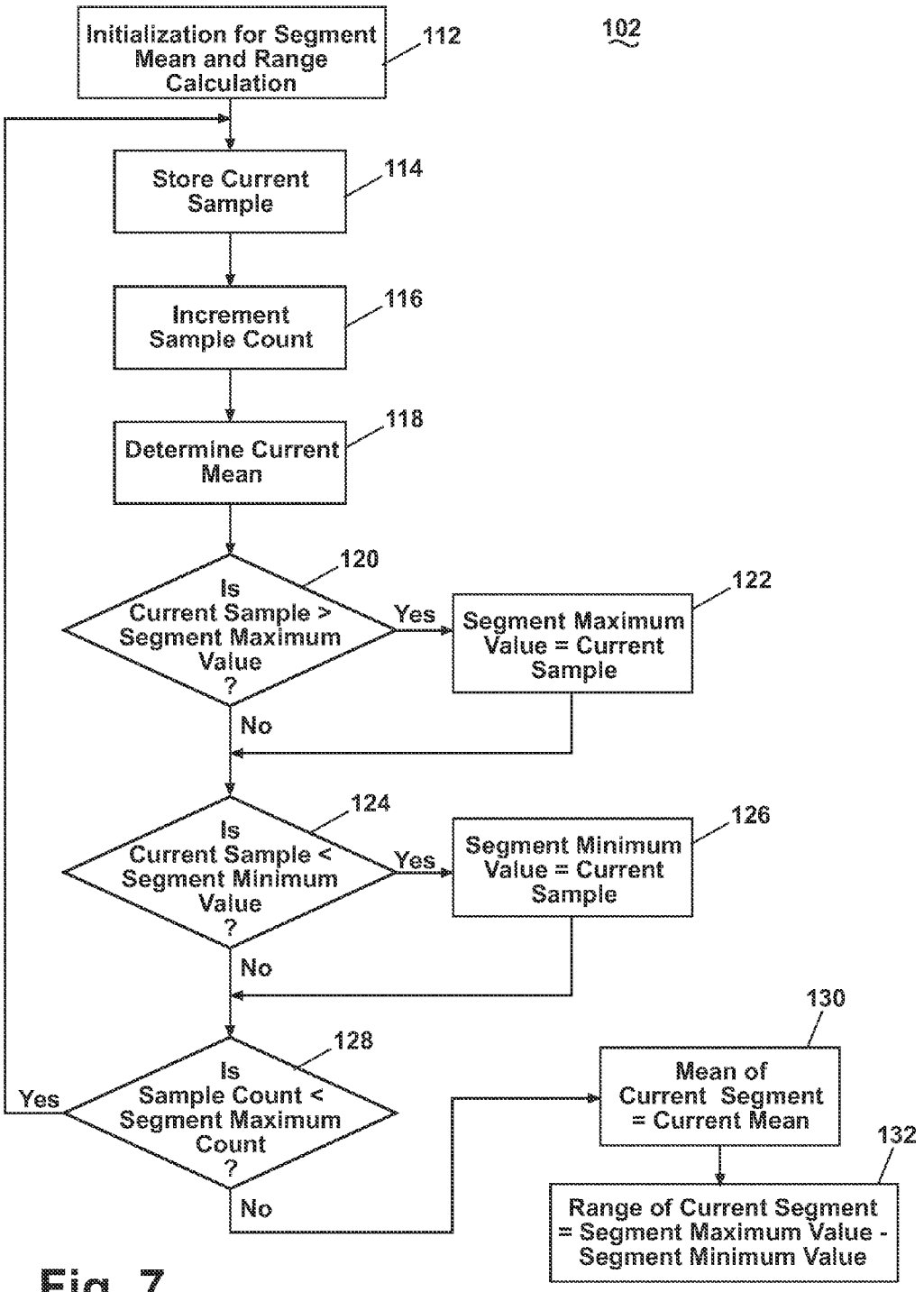
FIG. 7 is a flow chart depicting a method to calculate the mean and range of a segment containing a collection of analog pressure sensor signals.
Figure 8:
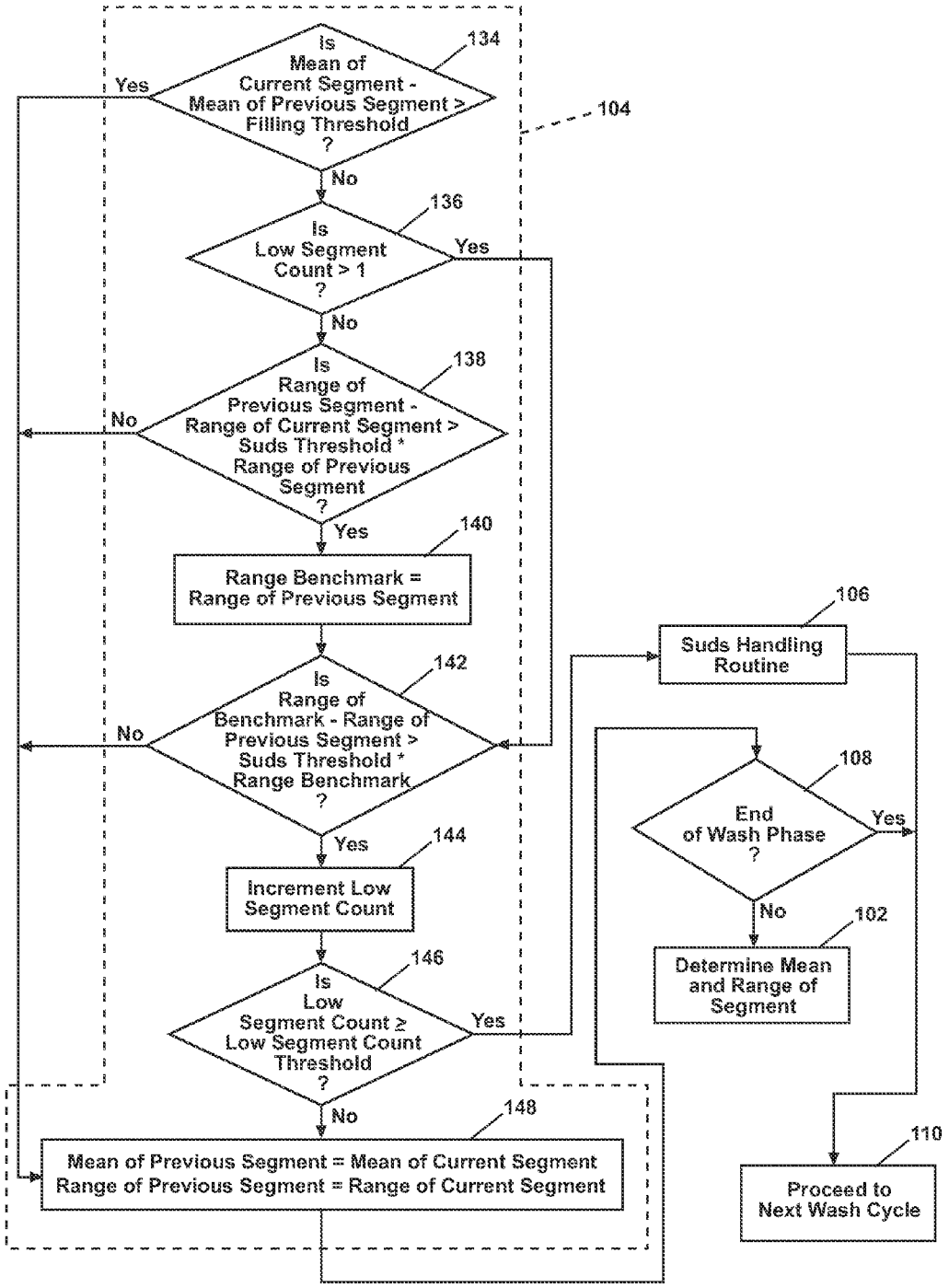
FIG. 8 is a flow chart depicting a method to determine an over-sudsing condition based on the range and mean of segments as determined in the method of FIG. 7.

As can be seen from FIGS. 2-5, the fluctuation in the analog pressure signal may be used to identify the presence of an OSC. FIGS. 6-8 disclose different methods for using the analog pressure signal to identify the presence of an OSC.

A method according to the invention is described with reference to FIGS. 6-10, which is a flow chart describing the method of determining an OSC in the tub 14 of the laundry treating appliance 10. The first step is to Determine and Initialize Variables at 100. These variables will be needed for the subsequent calculations for determining an OSC. The variables that need to be set include a Suds Threshold, Segment Maximum Count, and Low Segment Count Threshold. Both of these threshold values are required for the over-sudsing determination. After Determining and Initializing Variables 100, the Mean and Range of the Current Segment may be Determined at 102, followed by using the range and mean information to Determine if an OSC exists at 104. If it is determined that an OSC does exist, then a corrective action can be taken, such as the execution of a Suds Handling Routine at 106 may be run. Conversely, if it is determined that an OSC does not exist in the tub 14 thus far into the wash cycle, then it is determined if it is the End of the Wash Phase at 108. If it is determined that it is the end of the wash phase, then the laundry treating appliance 10 may Proceed to the Next Wash Cycle at 110. If, however, it is not the End of the Wash Phase, then the method may return to Calculating the Mean and Range at 102 of the next segment.

Corrective action in response to an OSC may include, but is not limited to, stopping the cycle of operation, moving to the next wash phase, adding water to the tub 14, draining wash liquor from the tub 14, or any combinations thereof.

The procedure for Mean and Range Calculation of the Current Segment at 102 is shown in greater detail in FIG. 7. First, various variables are initialized in Initialization for Segment Mean and Range Determination at 112. This involves setting Current Sample, Sample Count, Current Mean, Segment Maximum Value, and Segment Minimum Value variables each to zero. Next, the Current Sample is Stored at 114 from the sensor 60 to the electronic memory 64. Next, the Sample Count is incremented at 116. If this is the first sample point of this segment, then the Sample Count increases from zero to one. If this is the last sample point of the segment, then the Sample Count increments from (Segment Maximum Value −1) to Segment Maximum Value. After incrementing the Sample Count 116, the Current Mean is Determined at 118. The Current Mean may be Determined by the following equation:

$$\text{Current_Mean} = \frac{\left(\begin{array}{c}(\text{Sample_Count} - 1) * \text{Previous_Current_Mean} + \\ \text{Current_Sample}\end{array}\right)}{\text{Sample_Count}}$$

Where Current_Mean is the mean up to and considering the present sample within the segment, Sample_Count is the count of the current sample, Previous_Current_Mean is the mean up to and considering the previous sample within the segment, Current_Sample is the current sample pressure sensor 60 value.

Next, it is determined if the Current Sample is greater than the Segment Maximum Value at 120. If it is, then the Segment Maximum Value is set to the Current Sample at 122. If the Current Sample is not greater than the Segment Maximum Value, then it is determined if the Current Sample value is less than the Segment Minimum Value at 124. If it is, then the Segment Minimum Value is set to the Current Segment at 126. If it is not, then it may be determined if the Sample Count is less than the Segment Maximum Count at 128. If the Sample Count is less than the Segment Maximum Count, then the procedure loops back to storing the next pressure sensor sample at 114. If, however, the Sample Count is not less than the Segment Maximum Count, then the last sensor sample for the current segment has been considered in the mean and range of segment calculation at 102. At that point, the Mean of Current Segment is set to Current Mean at 130 and Range of Current Segment is set to the difference of the Segment Maximum Value and the Segment Minimum Value at 132.

The method of Calculating the Mean and Range of the Segment at 102 is a particularly non-memory intensive method, as only the Current Sample value, along with the Current Mean, Segment Maximum Value, and the Segment Minimum Value are stored in memory 64 at any given time to Calculate the Segment Mean and Range at 102. There are however, other ways to determine the Mean and Range of the Segment, such as by loading all of the samples from a particular segment into memory and averaging and comparing within those data points. Such means may be more memory intensive, computationally intensive, or both.

Once the Mean and Range of the present segment is determined at 102, it is determined if an OSC exists in the current segment at 104. The details of 102 are shown in FIG. 8. First, it is determined if the Mean of the Current Segment minus the Mean of the Previous Segment is greater than the Filling Threshold at 134. If it is, then the Mean of the Previous Segment is set to the Mean of the Current Segment and Range of the Previous Segment is Set to the Range of the Current Segment at 148. This is done in preparation for executing the Determine OSC at 104 analysis of the next segment. The Mean and Range of the Previous Segment may be stored in the electronic memory 64. After setting the Mean and Range of the Previous Segment 148, the method finishes the Determine Over-sudsing at 104 and continues on with 108 and 102 or 110. If it was determined that the Mean of the Current Segment minus the Mean of the Previous Segment is not greater than the Filling Threshold at 134, then it is determined if the Low Segment Count is greater than 1 at 136. If the Low Segment Count is not greater than 1, then it is determined if the Range of the Previous Segment minus the range of the current Segment is greater than a product of a Suds Threshold with the Range of the Previous Segment at 138. If it is, then the Range Benchmark is set to the Range of the Previous Segment at 140. Next, it is determined if the Range Benchmark minus the Range of the Previous Segment is greater than the product of the Suds Threshold and the Range Benchmark at 142. If it is, then the Low Segment Count is Incremented at 144. The Low Segment Count is a Variable that keeps count of how many low segments have been detected below the Product of Suds Threshold and Range Benchmark. Next it is determined if the Low Segment Count exceeds a Low Segment Count Threshold at 146. If it does, then an OSC is declared and the method proceeds to Suds Handling Routine at 106. However, if at 146 it is found that the Low Segment Count is not greater than the Low Segment Count Threshold, then the Mean and Range of the Previous Segment are set to the Mean and Range of the Current Segment and the Determine OSC at 104 is finished. At 136, if the Low Segment Count is greater than 1, then the process of setting the Range Benchmark is circumvented at 138 and 140. Instead, the method proceeds to determining if the difference between the Range Benchmark and Range of the Previous Segment is greater than the product of the Suds Threshold and Range Benchmark at 142. If it is not, then the method sets the Mean and Range of the Previous Segment to the Mean and Range of the Current Segment at 148 and finishes the Determine OSC at 104.

Basically, 104 is checking if the Current Segment Range is a predetermined fraction of the Previous Segment Range. The predetermined fraction is the Suds Threshold, which may be a scalar quantity between 0 and 1. For example, it may be 0.5. In that case, at 138 a drop of half or more from one segment to the next is checked. Once a drop in the range from one segment to the next by a half is identified, the Range of the Previous Segment is set as the Range Benchmark. Ranges from subsequent segments are then checked to see if they are the predetermined fraction (Suds Threshold) of the Range Benchmark. If it is, then that segment is counted as a low segment, by Incrementing the Low Segment Count at 144. When the Low Segment Count reaches a predetermined count of Low Segment Count Threshold, an OSC is declared. In other words, a low Range of the Current Segment compared to the Range Benchmark must be observed for at least a Low Segment Count Threshold number of segments before an OSC is declared.

Comparing the difference between the Mean of the Current Segment and the Mean of Previous Segment to a Filling Threshold at 134, may prevent a false Low Segment Count increment from being registered while the tub 14 is being filled. During the tub filling process, spurious signals may be obtained from the pressure sensor 60 that is not necessarily indicative of the level of sudsing in the tub 14. Such signals may manifest themselves as a large difference between the Mean of the Current Segment and Mean of the Previous Segment.

Figure 9:
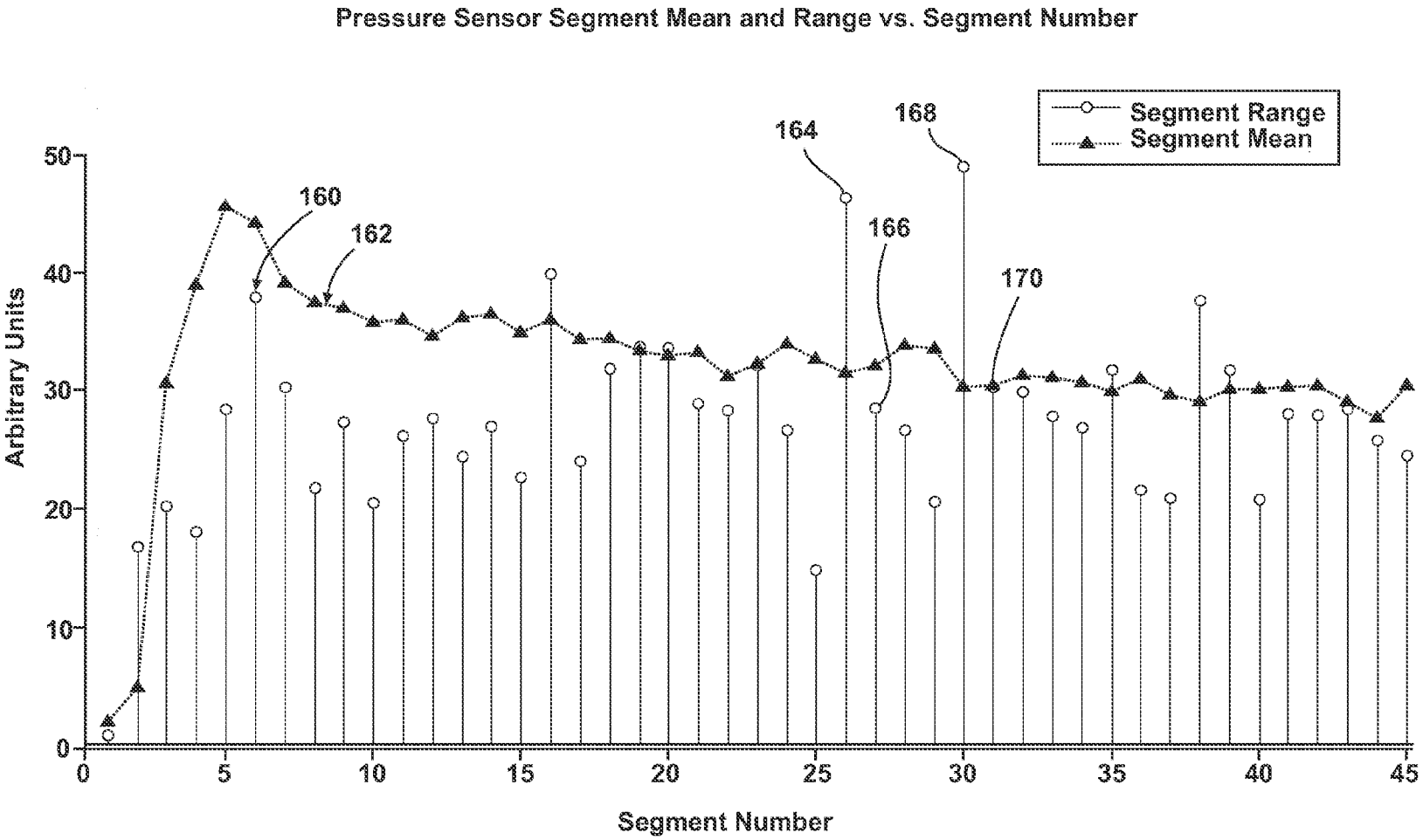
FIG. 9 is graph of range and mean from a time series of segments containing a collection of analog pressure sensor signals for a cycle of operation without an over-sudsing condition.
Figure 10:
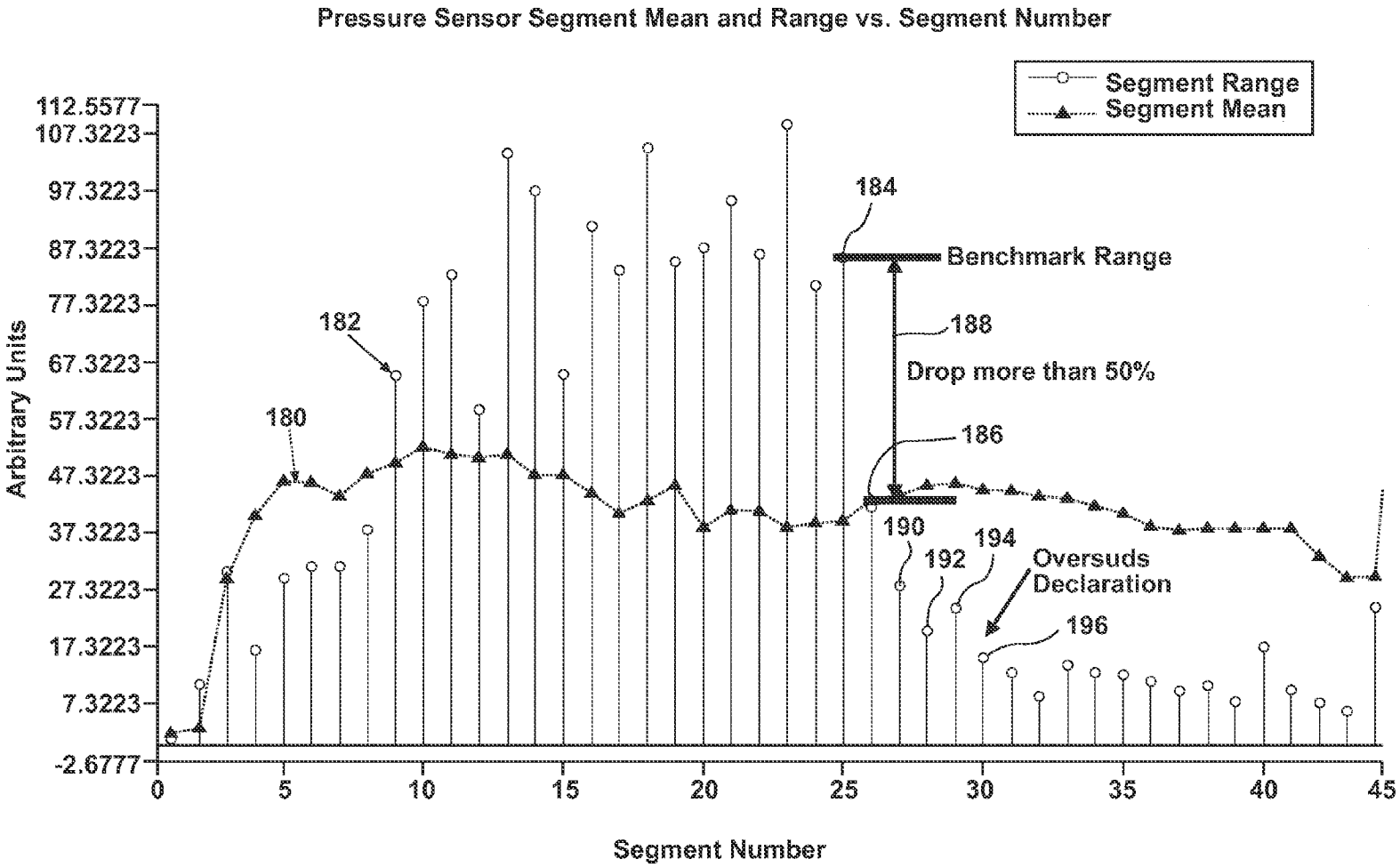
FIG. 10 is graph of range and mean from a time series of segments containing a collection of analog pressure sensor signals for a cycle of operation with an over-sudsing condition.

The methods for detecting an OSC as described in conjunction with FIGS. 6-8 will now be shown by example in FIG. 9 in a non-over-sudsing condition and FIG. 10 in an OSC. In these examples, the Suds Threshold Value is 0.5, the Low Segment Count Threshold is 5, the pressure sensor 60 sampling frequency is 1000 Hz, each segment is 60 seconds, with each segment containing 60,000 pressure sensor samples. FIG. 9 shows a time series of Segment Means 160 and Segment Ranges 162 as determined in the Calculate Mean and Range of Segment at 102 of the method disclosed.

It can be seen that there are relatively large drops in subsequent Segment Range Points 164 and 166 and then again between points 168 and 170. However, the Suds Threshold of a drop in half is not met for either set of points. Therefore, there are no two points in this pressure sensor data set where a clear and sustained reduction in the Segment Range 160, as defined by the Suds and Low Segment Count Threshold values can be observed. As a result, no OSC is detected.

FIG. 10 again graphs a time series of Segment Means 180 and Segment Range 182. Approximately 25 minutes into the wash cycle of operation, there is a large drop in the Segment Range point 184 to point 186. This drop is greater than 50% as indicated by arrow 188 and therefore satisfies the Suds Threshold value of 0.5 between subsequent points. At this point, the Benchmark Range is set the value of point 184 as described in 140. Next, the Low Segment Count is incremented from 0 to 1 as described in 144. As the Low Segment Count is not greater than the Low Segment Count Threshold at 146, the next Segment Range 190 is considered and compared to the Benchmark Range. Since Segment Range 190 is less than the product of the Suds Threshold and the Benchmark Range at 142, the Low Segment Count at 144 is again incremented to 2. This process of comparing the Segment Range keeps repeating for Segment Range points 192, 194, and 196, with the Low Segment Count incrementing each time. At Segment Range point 196, the Low Segment Count is 5 and is equal to the Low Segment Count Threshold as described in 146. As a result, an over-suds condition is declared approximately 30 minutes into the wash cycle of operation and the laundry treating appliance 10 may proceed to Suds Handling Routine at 106.

Suds handling routine at 106 may be any known number of methods to reduce the amount of sudsing in the tub 14, including, but not limited to adding additional water from water source 32, pausing the cycle of operation, or a combination thereof.

The method disclosed herein has used the range within a segment as a measure of the fluctuation of the pressure sensor 60 signal over a segment. There may be other effective methods of representing the fluctuation of the pressure sensor 60 signal within a time segment, including, but not limited to calculating the variance or the standard deviation of all the samples within the segment.

The methods disclosed herein may be implemented with no additional hardware than those present on many standard laundry treating appliances. The method is also not computationally or memory intensive and can be implemented with little or no burden on the controller 62 and the electronic memory 64 of the laundry treating appliance 10.

Washing laundry in a laundry treating appliance 10 may involve chemical, mechanical and thermal means to wash the laundry. The mechanical means require a transfer of mechanical energy from the rotating drum 16 to the laundry as the laundry is partially lifted and dropped back onto the inner surface of the drum 16. If there are too many suds present within the drum, the surface coefficient of static friction of the inside wall of the drum 16 and the baffles 22 disposed therein may be reduced and lift the laundry to a lower height than if there was not excessive sudsing. As such, the clothes may fall from a lower height onto the inner surface of the drum 16 and thereby result in a reduced transfer of mechanical energy from the rotating drum 16. Additionally, if an OSC is present within the drum 16, the falling laundry onto the inside wall of the drum 16 may be damped and thereby provide a second mechanism for reduced mechanical energy transfer from the rotating drum 16 to the laundry. As a result, it is important to know if there are too many suds present in the drum 16, so that the suds can be reduced before proceeding with the wash so that the laundry may be washed properly. The method disclosed herein provides a cost effective means of detecting such an OSC without adding any additional hardware to most typical laundry treating appliances.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for determining an over-sudsing condition in a laundry treating appliance comprising multiple components for implementing a washing cycle of operation including: a tub for holding liquid, a drum defining a treating chamber rotatably mounted within the tub, a pressure sensor fluidly coupled to the tub and outputting a signal indicative of an amount of water in the tub, and a controller coupled to and controlling the components, including receiving the signal and implementing the cycle of operation, the method comprising:

rotating the drum while the tub contains a foamable liquid;

determining, over time, a fluctuation in the signal from the pressure sensor while the drum is rotating;

determining an over-sudsing condition when a variance of a magnitude of the fluctuation satisfies a predetermined threshold; and altering the cycle of operation in response to the determination of the over-sudsing condition.

2. The method of claim 1 wherein a variance of a magnitude of the fluctuation is determined for at least a first segment and a second segment.

3. The method of claim 2 wherein the predetermined threshold is half of the determined variance of the magnitude of the fluctuation for the first segment and satisfying the predetermined threshold comprises the variance of the magnitude of the fluctuation for the second segment being less than the predetermined threshold.

4. The method of claim 1 wherein the determining the over-sudsing condition occurs only during the rotation of the drum.

5. The method of claim 1 wherein the altering the cycle of operation comprises at least one of altering a parameter of the cycle of operation, altering a phase of the cycle of operation, adding a phase to the cycle of operation, or terminating the cycle of operation.

6. The method of claim 5 wherein the altering the parameter comprises at least one of altering a rotational direction or altering a rotational speed of the drum.

7. The method of claim 1 wherein the determining the variance of the magnitude of the fluctuation comprises determining a zero-centered signal formed by subtracting an average of the signal from the signal.

8. The method of claim 7 wherein the average of the signal comprises a moving average of the signal.

9. A method for determining an over-sudsing condition in a laundry treating appliance comprising multiple components for implementing a washing cycle of operation including: a tub for holding liquid, a drum defining a treating chamber rotatably mounted within the tub, a pressure sensor fluidly coupled to the tub and outputting a signal indicative of an amount of water in the tub, and a controller coupled to and controlling the components, including receiving the signal and implementing the cycle of operation, the method comprising:

rotating the drum while the tub contains a foamable liquid;

repeatedly determining, over time, a fluctuation in the signal from the pressure sensor while the drum is rotating to define multiple segments with each segment having a variance of a magnitude of the fluctuation;

determining the magnitude of the variance of the fluctuation of a segment is less than a predetermined fraction of the magnitude of the variance of the fluctuation of a previous segment;

setting a benchmark defined by the predetermined fraction of the magnitude of the variance of the fluctuation of the previous segment;

determining an over-sudsing condition when the magnitude of the variance of the fluctuation of a set of segments is less than the benchmark; and altering the cycle of operation in response to the determination of the over-sudsing condition.

10. The method of claim 9 wherein the set of segments is a predetermined number of sequential segments.

11. The method of claim 9 wherein the predetermined fraction is one half.

12. A laundry treating appliance to implement a cycle of operation with means to determine an over-sudsing condition, the appliance comprising:

a tub for holding liquid;

a drum defining a treating chamber rotatably mounted within the tub;

a pressure sensor fluidly coupled to the tub and outputting a signal indicative of an amount of water in the tub; and a controller coupled to and controlling the tub, drum and the pressure sensor, including receiving the signal and implementing the cycle of operation, wherein while drum is rotated while the tub contains a foamable liquid, the controller carries out at least a method for determining an over-sudsing condition in a laundry treating appliance comprising multiple components for implementing a washing cycle of operation, the method comprising:

rotating the drum while the tub contains a foamable liquid;

determining, over time, a fluctuation in the signal from the pressure sensor while the drum is rotating;

determining an over-sudsing condition when a variance of a magnitude of the fluctuation satisfies a predetermined threshold; and altering the cycle of operation in response to the determination of the over-sudsing condition.

13. The laundry treating appliance of claim 12 wherein the pressure sensor is an analog pressure sensor.

14. The laundry treating appliance of claim 13 wherein the pressure sensor is located external to the tub.

15. The laundry treating appliance of claim 12 further comprising a sump containing wash fluid.

16. The laundry treating appliance of claim 15 further comprising an air trap and flexible tube coupling the pressure sensor to the sump.

17. The laundry treating appliance of claim 12 wherein the predetermined threshold is stored in the controller and is changeable.

18. The laundry treating appliance of claim 12 wherein the controller alters the cycle of operation by at least one of altering a parameter of the cycle of operation, altering a phase of the cycle of operation, adding a phase to the cycle of operation, or terminating the cycle of operation.

19. The laundry treating appliance of claim 18 wherein the altering the parameter comprises at least one of altering a rotational direction or altering a rotational speed of the drum.

20. The laundry treating appliance of claim 12 wherein the controller determining the variance of the magnitude of the fluctuation comprises determining a zero-centered signal formed by subtracting an average of the signal from the signal.

* * * * *